US005142988A

United States Patent [19]

Ganz

[11] Patent Number: 5,142,988

[45] Date of Patent: Sep. 1, 1992

[54] AUXILIARY RAILROAD TRACK LIFTING INSTALLATION

[75] Inventor: Jörg Ganz, Etoy, Switzerland

[73] Assignee: Matisa Materiel Industriel S.A., Crissier, Switzerland

[21] Appl. No.: 662,776

[22] Filed: Feb. 28, 1991

[30] Foreign Application Priority Data

Apr. 10, 1990 [CH] Switzerland ..... 1242/90

[51] Int. Cl.[5] ..... E01B 27/00

[52] U.S. Cl. ..... 104/7.1

[58] Field of Search ..... 104/7.1, 7.2, 7.3, 10, 104/12, 2

[56] References Cited

U.S. PATENT DOCUMENTS

| | | | |
|---|---|---|---|
| 3,795,198 | 3/1974 | Plasser et al. | 104/7.3 |
| 3,832,952 | 9/1974 | Hurni | 104/7.2 |
| 4,457,234 | 7/1984 | Theurer et al. | 104/7.2 |
| 4,635,557 | 1/1987 | Mohr et al. | 104/12 |
| 4,774,890 | 10/1988 | Theurer | 104/7.1 |
| 4,878,435 | 11/1989 | Theurer | 104/7.1 |
| 5,007,350 | 4/1991 | Theurer | 104/7.1 |

FOREIGN PATENT DOCUMENTS

| | | | |
|---|---|---|---|
| 2605969 | 9/1976 | Fed. Rep. of Germany | 104/7.2 |
| 2065753 | 7/1981 | United Kingdom | 104/7.2 |

*Primary Examiner*—George E. A. Halvosa
*Assistant Examiner*—Mark T. Le
*Attorney, Agent, or Firm*—Darby & Darby

[57] ABSTRACT

An auxiliary railroad track lifting assembly for assisting conventional lifting grippers of a railroad track construction machine, especially a tamper, in lifting a switchgear unit includes a lifting device carried by an arm articulated, at its end remote from the lifting device, on a carriage movable along a rail fastened to the flank of the machine. The assembly permits displacement of the construction machine between at least two successive tamping position in the longitudinal direction of the track with the auxiliary assembly remaining stationary.

20 Claims, 6 Drawing Sheets

AUXILIARY RAILROAD TRACK LIFTING INSTALLATION

FIELD OF THE INVENTION

The present invention relates to an auxiliary railroad track lifting installation or assembly intended for equipping a railroad track construction machine, especially a tamper, for assisting the conventional means equipping the said machine for lifting a switchgear unit.

PRIOR ART

Since switchgear units have become larger and heavier to allow the passage of trains at relatively high speed and because the ties are increasingly made from concrete, it is difficult, during tamping, to lift the switchgear units at only two points located under the machine traveling on one of the tracks. In fact, so that this lifting can be executed, on the one hand it is necessary that the lifting means be capable of supporting higher loads and on the other hand, because the track or switchgear unit is lifted by grasping only the rails by means of grippers, the fastenings of the rails to the concrete ties are easily overloaded and even torn from their seating, because the lifted load supported by the fastenings is higher.

In order to avoid the above-mentioned disadvantages, various means have been proposed for carrying out a lifting of the switchgear units at more than two points, that is to say in addition to the grippers of the tamper traveling on a track. Thus, an auxiliary device is used, making it possible simultaneously to lift the diverted or adjacent track at a point on its outer rail. Auxiliary devices used include a mechanical jack handled and displaced by a workman, with the attendant disadvantages in terms of cost and insufficient speed, or a hydraulic jack which is likewise handled and displaced by a person and, though it is easier to handle, the displacement of which has the same disadvantages as the mechanical jack, or a crane placed on a tamper, this having the advantage of reducing the laborious handling operations, but having the disadvantage that the machine must support high forces and a high torque, thus becoming larger, heavier and therefore more expensive.

SUMMARY OF THE INVENTION

The object of the present invention is to provide an auxiliary lifting installation making it possible to mitigate the above-mentioned disadvantages.

The installation according to the present invention is defined in that it comprises at least one arm carrying, at one of its ends, a device equipped with means for making it possible to grasp and lift a railroad track rail by bearing on the subgrade, and articulated at its second end on the said machine, the said arm being designed to allow the displacement of the machine between at least two tamping positions consecutive in the axial direction of the railroad track, whilst at the same time maintaining the said device in place, and the relative displacement of the said device in relation to the machine, and means for the remote control of the said installation.

The advantages of this solution are as follows: Since the lifting device operates by bearing on the subgrade, the machine is not subjected to an additional load or to any torque. On the other hand, the installation, especially the second end of the arm, is designed to allow the tamper to advance between at least two consecutive tamping positions, without the displacement of the lifting device being necessary, thus contributing to increasing the working speed of the machine.

The fact that the installation is controlled remotely also makes it possible to avoid the additional labor for both the control and the displacement of the said lifting device.

The installation is flexible, since the spacing between the diverted track and the track on which the machine is located has no direct influence on the positioning of the lifting device, the pivoting of the arm about its approximately vertical pivot axis making it possible to adapt to the said spacing which varies as the machine advances.

According to one embodiment, the arm can be extendable so as to be capable of adapting to extreme situations, that is to say, at the start of the diversion, the outer rail of the diverted track is relatively near to the main track, and in this case, if the length of the arm is relatively large, the auxiliary lifting point risks being too far offset in relation to the two conventional lifting points and thus producing an undesirable imbalance during the lifting of the unit.

According to another preferred embodiment, the movable device on which the arm is articulated is a carriage which is displaced on an approximately horizontal rail arranged on the lateral face of the machine and which is controlled by a chain tensioned between two pulleys, at least one of which is the driving pulley. It is also possible to utilize a flexible transmission link, such as a belt, for driving the movable device. The displacement of the movable device by means of a jack can also be considered.

According to another preferred alternative embodiment, the pivoting of the arm, especially for first putting the lifting device in place and for retracting it for light running, is carried out by means of at least one jack.

According to a preferred embodiment, the arm is articulated on a second arm which is articulated on the machine about a pivot axis at least approximately perpendicular to the track. This second arm can pivot about the pivot axis by means which can consist either of a simple return device, or of a jack, or of a gear train, or even of a flexible transmission link, such as a chain or belt.

It is also possible to provide a device acting on the articulation between the two arms, in order to allow the first arm to pivot about its articulation on the second arm.

According to another embodiment, the first arm is articulated at its second end directly on the machine by means making it possible to vary the distance between its first end and the point of articulation, for example by displacing the first arm in a bushing articulated on the machine by mechanical means, such as a rack, jack, belt, etc.

According to another preferred embodiment, the lifting device is equipped with at least two rollers making it possible to roll on the rail in a released position in order to pass from one lifting position to another.

According to another preferred embodiment, the lifting device is furthermore equipped with a motor for ensuring the displacement of the device on the rail between two consecutive working positions.

The supply of energy both to the lifting device and to the possible drive motor is ensured by means of the hydraulic energy of the tamper. It is possible, according to the various alternative versions, to provide the operation of the lifting device (grasping and lifting) either in synchronism with the grippers of the tamper or independently and as a function of the various parameters particular to the measurement base of the tamper.

BRIEF DESCRIPTION OF THE DRAWINGS

The invention will be described in more detail by means of the accompanying drawing.

DESCRIPTION OF THE PREFERRED EMBODIMENTS

Figure 1:
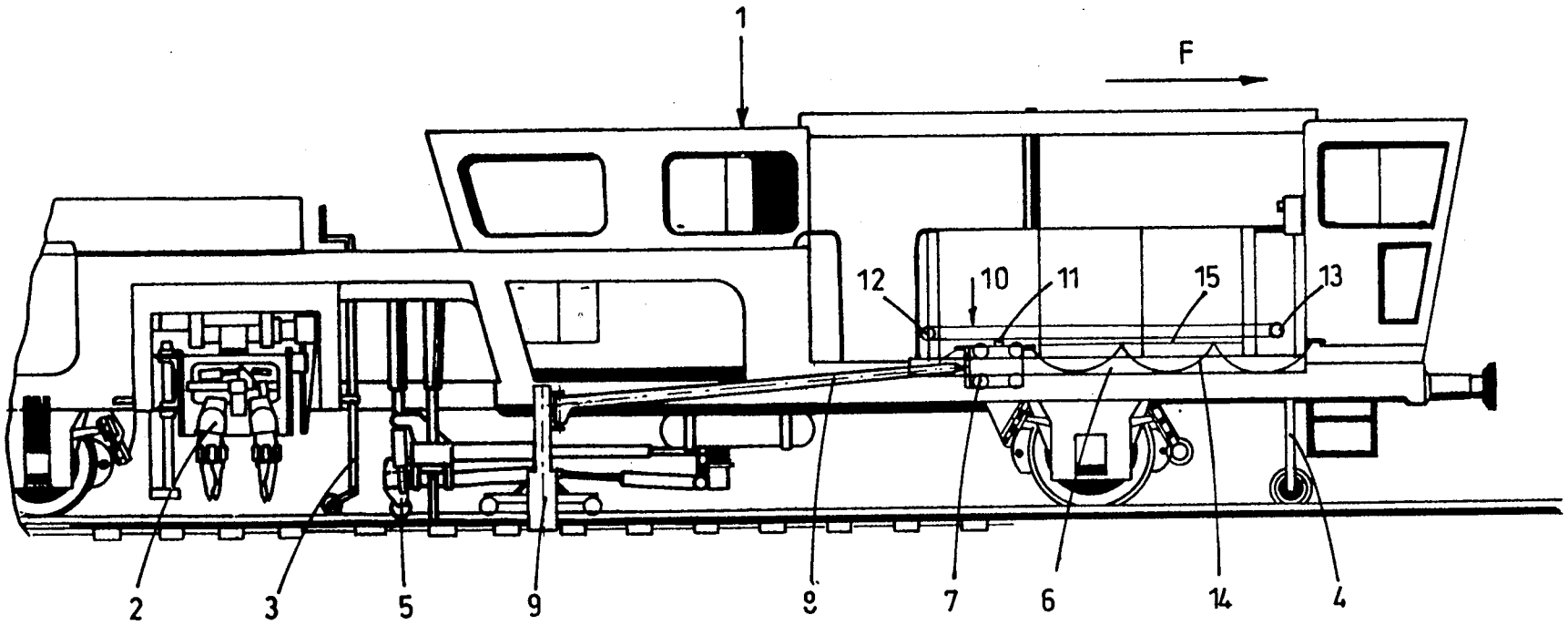
FIG. 1 is a side view of a tamper equipped with an installation according to the invention, presented diagrammatically.

Thus, FIG. 1 illustrates a tamping machine 1 equipped with conventional devices, such as a tamping assembly 2, two tracers 3 and 4 and conventional lifting grippers 5. Installed on the lateral face of the machine is a rail 6, on which rolls a carriage 7, on which an arm 8 is articulated, whilst a rail grasping and lifting device 9 is articulated on its other end. The carriage 7 is displaced by means of a chain 10, in which a finger 11 firmly fixed to the carriage 7 engages, whilst the chain is supported by two pulleys 12 and 13, at least one of which is a driving pulley. Another flexible transmission link, such as a belt, can be used.

Figure 2:
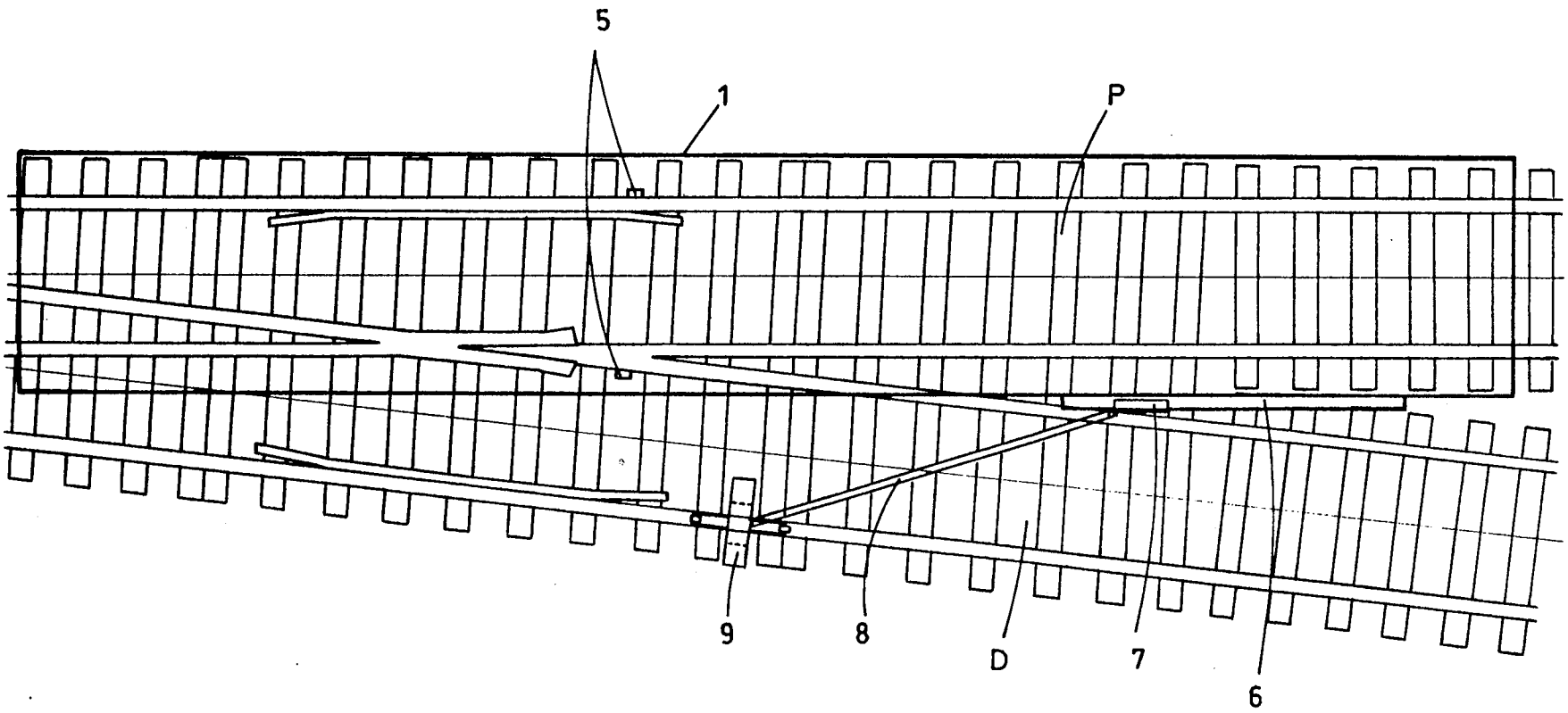
FIG. 2 is a plan view of the preceding figure, the machine being represented solely by a frame, and the installation according to the invention being illustrated diagrammatically.

The device 9 is supplied by means of hoses 14 suspended on a support 15 likewise located on the lateral face of the machine 1. It should be noted that the rail 6 is arranged approximately parallel to the axis of the track on which the machine travels. FIG. 2 shows diagrammatically, by means of a solid line, the machine 1, the main track P on which the machine travels, and the diverted track D. We have shown on the flank of the machine the rail 6, on which the carriage 7 is displaced, and the arm 8 and the lifting device 9. Thus, by means of the device 9, which will be described later, the switch-gear unit is lifted at three points, one at the location of the device 9 and the other two in the positions occupied by the grippers 5, thereby making it possible to reduce the load supported by the grippers 5 and consequently the machine 1. During the advance of the machine, the presence of the rail 6 makes it possible to avoid having to displace the device 9 for each new lifting position, since the carriage 7 can be displaced freely on the said rail 6. Thus, even if the lifting of the track is carried out every two ties, there is no need to displace the device 9 for each lift, since to prevent the unit from being lifted at only one point it is sufficient simultaneously to lift and lower the unit at the three lifting points, namely: at the point where the device 9 is located and at the two points where the grippers 5 are located. Thus, during each advance of the machine, within the limits of the rail 6, it is sufficient to set the switchgear unit down at the three points, advance to the next points intended solely for the grippers 5, lift the track at the three bearing points, and so on and so forth. A synchronous supply and control of the device 9 and of the lifting grippers 5 is involved.

The height of the lifting action of device 9 is controlled, as in the case of the primary lifting grippers 5, by the measurement base. The measurement base control, as is known in the art, determined height displacement of the lifting means resulting from a difference between the actual and desired height of the railway track. The lifting force is controlled, as is known, such as to prevent overload of fasteners that connect rails to ties.

In principle, if the lifting of the switchgear unit is considered as taking place every two ties, the device 9 can be maintained in the same position for at least three different positions of grippers 5. Of course, this choice depends on the length of the rail 6 and of the arm 8 and primarily on the weight and dimensions of the switchgear unit or of the section of the switchgear unit to be lifted. When the carriage 7 reaches the end of its travel on the rail 6, during the next advance in the direction F the device 9 is likewise displaced by releasing the device which grasps the rails, at the same time causing it to roll on the said rails under the control of the displacement of the machine on the one hand and of the chain 10 on the other hand.

To make it possible to adapt to particular limiting situations, the arm 8 can be telescopic, especially when the distance between the main track and the diverted track is such that the device 9 is distant from the two lifting points for the grippers 5, thus risking unbalancing the machine. In this case, an extendable arm makes it possible to return the device 9 nearer to the two lifting positions for the grippers 5.

According to a preferred embodiment, the arm 8 is controlled y at least one jack allowing it to pivot so that it can be put in place on the outer rail of the diverted track and retracted under or next to the machine for light running.

Figure 1A:
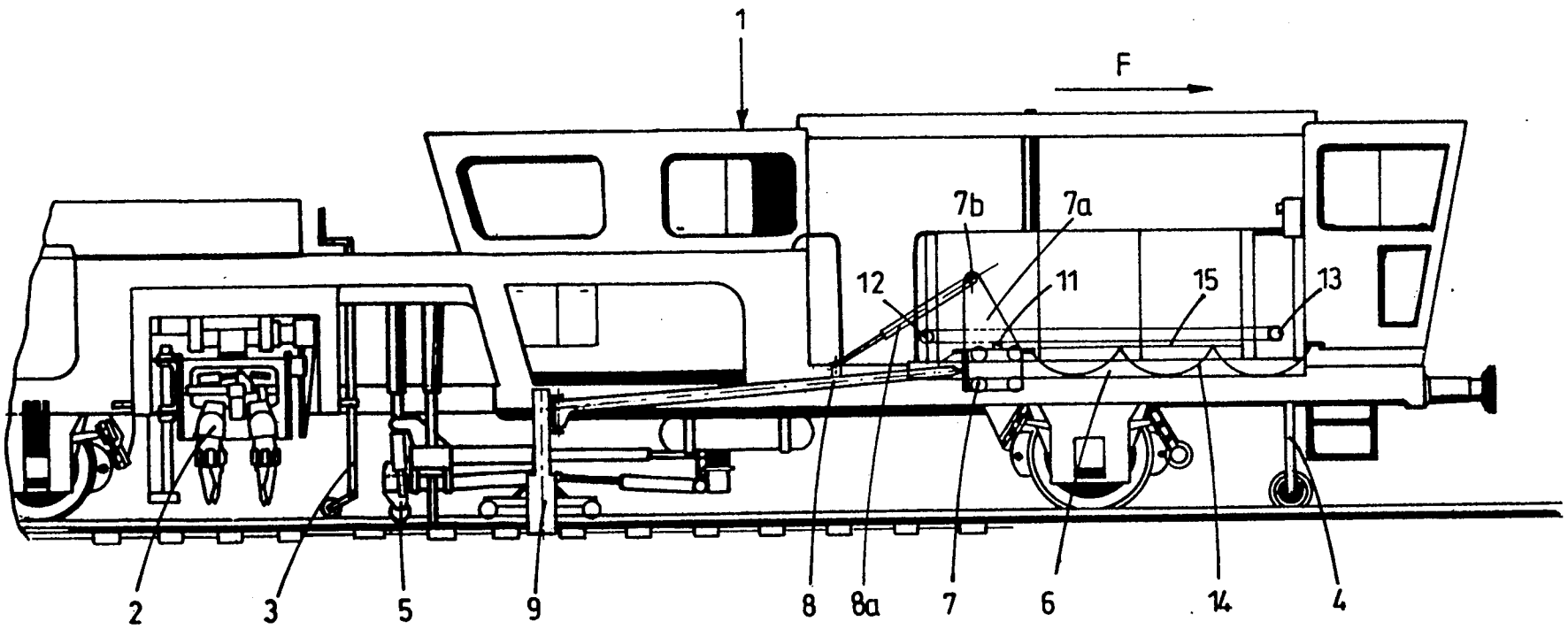
FIG. 1*a* is a view similar to that of FIG. 1, showing the same installation equipped with a device allowing the displacement of the arm in a plane at least approximately perpendicular to the plane of the track.

FIG. 1*a* illustrates the same installation, except that the carriage 7 is equipped with an extension 7*a* of triangular shape which extends upwards in a plane at least approximately perpendicular to the plane of the track and on which a jack 8*a* is articulated, by means of a ball joint 7*b*, for lifting the arm 8 in a plane at least approximately perpendicular to the plane of the track, to allow the device 9 to be put in place and to be retracted during the light running of the machine.

Figure 3:
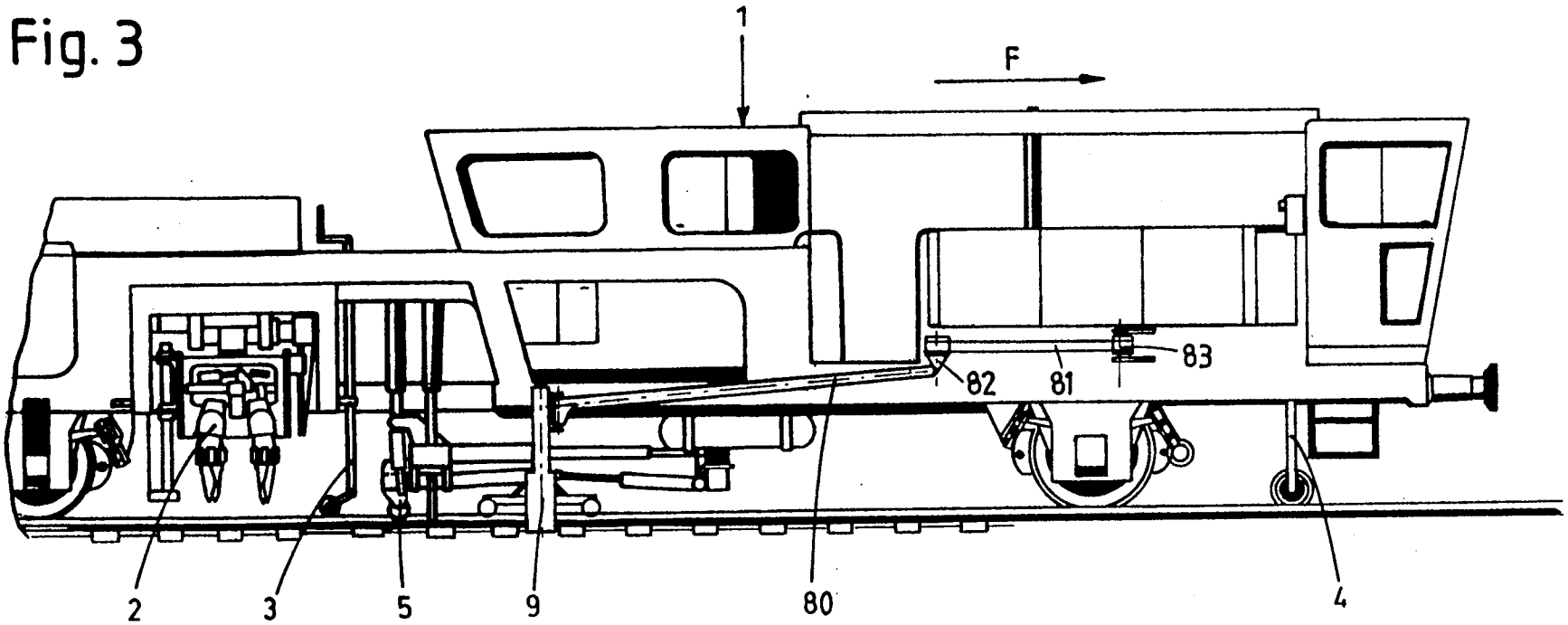
FIG. 3 is a side view similar to FIGS. 1 and 1*a*, showing another embodiment according to the invention.

FIG. 3 shows a side view of a construction machine equipped with a slightly different auxiliary lifting installation. The elements of FIG. 3 which are identical to those of FIGS. 1, 1*a* are represented by the same references.

Figure 3A:
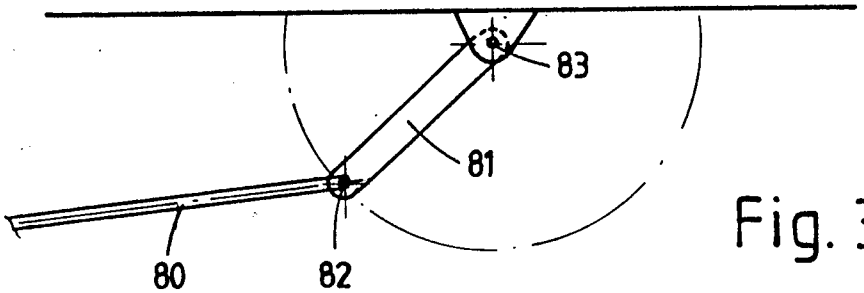
FIG. 3*a* is a partial plan view of the installation of FIG. 3.

The lever 80 is articulated at one of its ends on the lifting device 9 and at the other end, by means of a joint 82, on a second lever 81 which is itself articulated on the machine 1 by means of an axle 83. The lever 81 (see also FIG. 3*a*) can describe a semicircle about the axle 83. This can be obtained by means of a return device, for example a spring, which returns the lever 81 forwards (arrow F), that is to say in the direction of travel of the machine, and thus, when work begins, the lever 81 is in the position of rest, with the joint 82 located towards the front of the machine, whilst the device 9 is positioned at the lifting point, and thereafter, as the machine advances and in so far as the lifting device is not displaced, the lever 81 rotates about the pivot axle 83 rearwards and within the limits defined by the geometry of the switchgear unit to be lifted. When the lifting device 9 is to be displaced into the following position, this can be carried out solely by means of the return force returning the lever 81 towards the front part of the machine or also by other means (jack, gear, ...).

Of course, the joint 83 can be equipped with means for driving the lever 81 towards the desired position either by a gear train or by a jack or by a flexible transmission link, such as a chain, belt, etc.

It is also possible to provide a drive particular to the articulation point 82, so as to allow the arm 80 to pivot about this joint in order to make it possible to displace the device 9.

Figure 4:
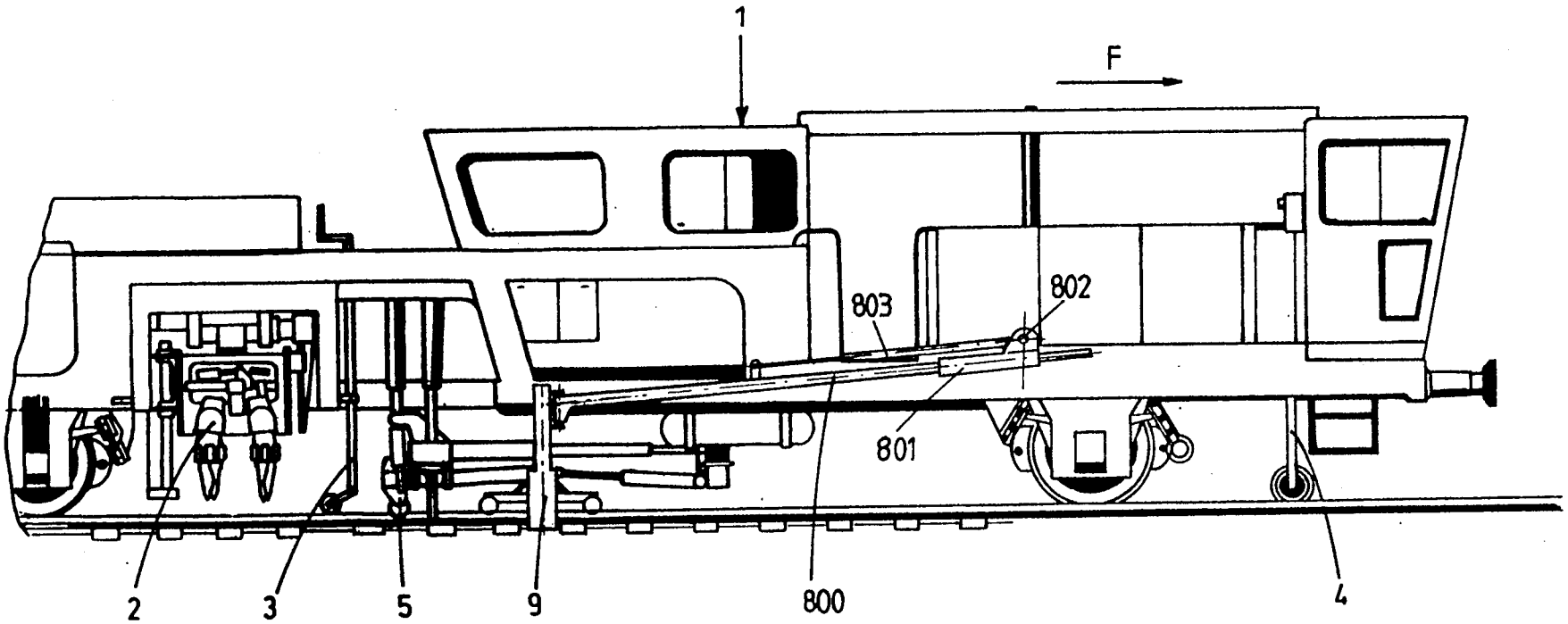
FIG. 4 is a side view of a tamper equipped with an installation according to another embodiment of the invention.

FIG. 4 likewise shows a side view of a machine for the tamping of a railroad track, the auxiliary lifting device 9 being located at the end of a lever 800 which is itself articulated, at its other end, on the machine via a bushing 801 suspended by means of a ball joint 802. This makes it possible to vary the distance between the points of articulation 802 and the end of the arm 800 articulated on the device 9 by means of a jack 803 bearing on the ball joint 802 on the one hand and at an intermediate point of the arm 800 on the other hand. It is also possible to provide another device for varying the distance between the ball joint 802 and the end of the arm 800 articulated on the auxiliary lifting device 9, for example a rack, pulley system, etc.

Figure 6:
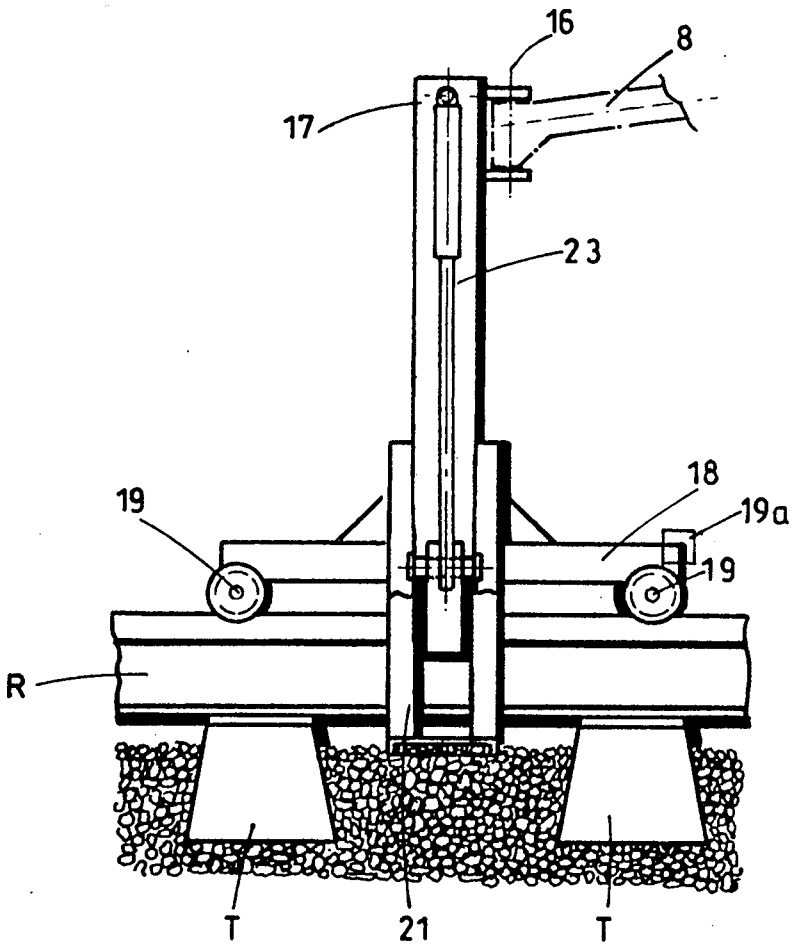
FIGS. 5 and 6 are two side views of an auxiliary lifting device.
Figure 5:
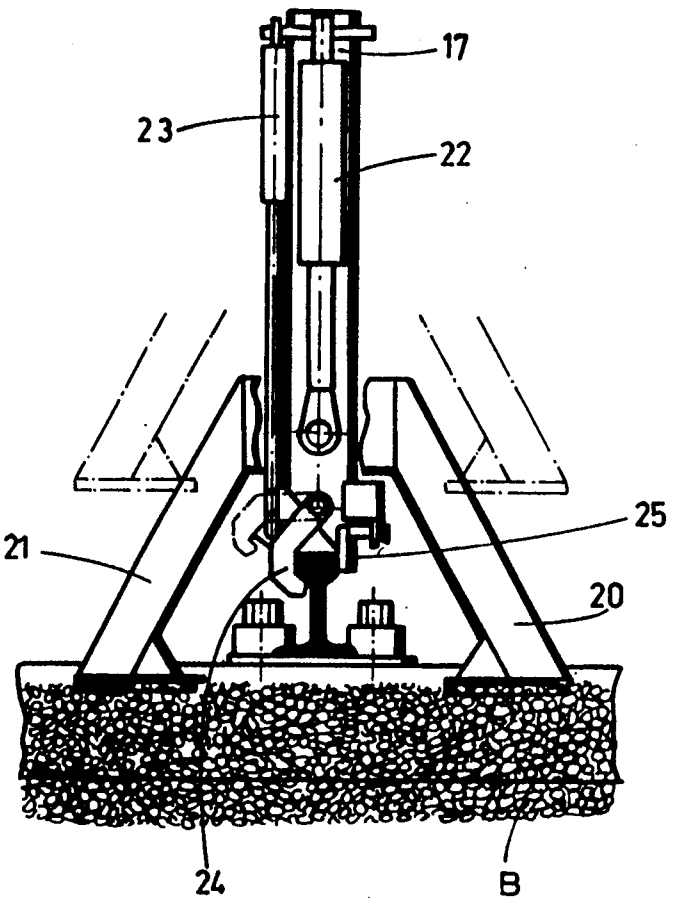

We shall now describe an embodiment of the device 9 by means of FIGS. 5 and 6.

The device 9 illustrated in FIGS. 5 and 6 is articulated on the arm 8 by means of an axle 16 or any other means. It consists of a supporting column 17 bearing on a bar 18 equipped with wheels 19 making it possible to roll on a rail of the diverted track D. Two bearing stays 20, 21 retractable by sliding linearly along the column 17 and controlled by a jack 22 firmly fixed to the column 17 ensure, by bearing on the ballast B, the lifting of the rail R and therefore of the unit through the ties to which the rail is fastened. Another jack 23 ensures that the rail is grasped by acting on a hook 24 which thus grasps the rail under the head, whilst a plate 25 serves as an abutment.

Of course, other embodiments of such a device can be considered. The control of the installation, and particularly of the device 9, is carried out remotely, that is to say from the cab of the machine, but the supply hoses of the two jacks 22, 23 are not shown in these figures.

It is also possible to equip the carriage 18 with a drive device **19*a*, supplied with hydraulic energy from the machine or even by an energy source particular to the device 9, in order to ensure its displacement between two consecutive working positions. In the latter case, it would also be possible not to equip the various alternative embodiments described above with devices making it possible to ensure relative displacement between the device 9 and the machine, since the device 19*a*** can be responsible for this.

It is likewise important to note that the lifting force and the lifting height for the device 9 are determined and controlled either in synchronism with the grippers 5 of the tamper or by means of a servo device dependent on the measurement base of the tamper.

The term "switchgear unit" utilized in the specification and claims means switch or crossing.

I claim:

1. An auxiliary railroad track lifting assembly to be mounted on a railroad track construction machine which has means for lifting a switchgear unit, said auxiliary assembly assisting the lifting means of the railroad track construction machine in lifting the switchgear unit and comprising at least one arm having a first and a second end; means pivotably attaching said first end to the construction machine; means secured as said second end for grasping and lifting a railroad track rail by bearing on a subgrade; and means for enabling displacement of the constructing machine at least between two consecutive tamping positions in an axial direction of the railroad track which said grasping and lifting means remains in place and for displacing the construction machine relative to said grasping and lifting means.

2. An assembly as set forth in claim 1 wherein said enabling means comprises linear guide means mounted on the construction machine at least approximately parallel to an axis of the railroad track, and means displacement along said linear guide means, said first end of said at least one arm being pivotally attached to said displacement means.

3. An assembly as set forth in claim 2 wherein said first end is pivotable at least about an axis extending approximately perpendicular to a plane of the railroad track.

4. An assembly as set forth in claim 2 wherein said linear guide means comprises a rail fastened to a flank of the construction machine, and said displaceable means comprises a carriage displaceable on said rail.

5. An assembly as set forth in claim 2, further comprising means for driving said displaceable means and including two rotary elements, of which at least one element is a driving element, and a flexible transmission link tensioned between said two rotary elements.

6. An assembly as set forth in claim 2, further comprising a jack for driving said displaceable means.

7. An assembly as set forth in claim 2 wherein said displaceable means has an extension, and said assembly further comprises a jack pivotally attached to said extension of said displaceable means and to said at least one arm for displacing said at least one arm in a plane extending at least approximately perpendicular to a place of the railroad track.

8. An assembly as set forth in claim 1 further comprising a second arm pivotally attached to the construction machine for pivotal movement about an axis extending at least approximately perpendicular to a plane of the railroad track.

9. An assembly as set forth in claim 8, further comprising means associated with said second arm for pivoting the same about said axis.

10. An assembly as set forth in claim 8, further comprising means for pivoting said at least one arm relative to said second arm.

11. An assembly as set forth in claim 1, wherein said means attaching said first end to the construction machine includes means for varying the distance between said first and second ends of said at least one arm.

12. An assembly as set forth in claim 11, wherein said varying means comprises a bushing for receiving said at least one arm, and mechanical means for controlling pivotal movement of said bushing.

13. An assembly as set forth in claim 1, wherein said grasping and lifting means includes roller means for rolling on the railroad track rail during displacement from one lifting position to another lifting position.

14. An assembly as set forth in claim 13, further comprising drive means for displacing said grasping and lifting means between said one and another lifting positions.

15. An assembly as set forth in claim 1 wherein said grasping and lifting means is powered by a source of hydraulic energy of the construction machine.

16. An assembly as set forth in claim 1 wherein said grasping and lifting means effects lifting synchronously with lifting carried out by the construction machine.

17. An assembly as set forth in claim 1 wherein said grasping and lifting means has an independent energy source.

18. An assembly as set forth in claim 17 wherein said independent energy source operates in accordance with a measurement base of the construction machine.

19. An assembly as set forth in claim 1 wherein said at least one arm has a variable length.

20. An auxiliary railroad track lifting assembly to be mounted on railroad track construction machine which has means for lifting a first track of a switchgear unit, said assembly comprising:

at least one arm having first and second ends;

linear guide rail means mounted on the railroad track construction machine at least approximately parallel to the axis of the first track of the switchgear unit;

carriage means displaceable along said rail means;

means pivotally attaching the first end of said arm to said carriage means;

means secured at the second end of said arm for grasping and lifting a second track of the switchgear unit; and means for enabling displacement of the railroad track construction machine at least between two consecutive tamping positions at an axial direction of said first track which said grasping and lifting means remains in place on said second track.

* * * * *